United States Patent [19]

DuMong

[11] Patent Number: 5,057,976

[45] Date of Patent: Oct. 15, 1991

[54] CHRISTMAS TREE LIGHT ASSEMBLY

[76] Inventor: Shella DuMong, 1403 S. Jameson La., Montecito, Calif. 93108

[21] Appl. No.: 507,169

[22] Filed: Apr. 10, 1990

[51] Int. Cl.[5] ..... F21P 1/02

[52] U.S. Cl. ..... 362/123; 362/239

[58] Field of Search ..... 362/123, 249, 252, 806, 362/238, 239

[56] References Cited

U.S. PATENT DOCUMENTS

| | | | |
|---|---|---|---|
| 3,096,943 | 7/1963 | Forrer | 362/806 |
| 3,723,723 | 3/1973 | Lerner | 362/806 X |
| 4,099,824 | 7/1978 | schoppelrey | 362/123 X |
| 4,404,621 | 9/1983 | Mauro | 362/806 X |
| 4,720,773 | 1/1988 | Ahroni | 362/249 |
| 4,736,282 | 4/1988 | Ahroni | 439/650 |
| 4,870,547 | 9/1989 | Crucefix | 362/123 |

*Primary Examiner*—Stephen F. Husar
*Attorney, Agent, or Firm*—Michael G. Petit

[57] ABSTRACT

A novel and improved Christmas tree lighting assembly which includes interconnected strings of conducting wires serving as a primary source of power for the lamps, a wall plug and a support member. When the assembly is wrapped around a Christmas tree, the assembly assumes a substantially conical form having an apex and a base. Strings of lights depending generally downward from the apex of the assembly are alternately interconnected with adjacent strings by means of a plastic clip. The resultant cloak-like assembly, when wrapped around the tree and fastened along a seam, completely encircles the tree with lights thereby providing a balanced distribution of lights over the entire surface of the tree, and, at the same time, providing more or less horizontal supporting elements from which to hang Christmas ornaments. Projecting upwardly from the apex of the assembly is a single strand of lights which may be used for decoratively winding around the top of the tree. The assembly provides for easy tangle-free storage and reuse.

1 Claim, 2 Drawing Sheets

CHRISTMAS TREE LIGHT ASSEMBLY

BACKGROUND OF THE INVENTION

1. Field of the Invention

This invention relates to the decorative illumination of Christmas trees and particularly to an improved construction for a multi-element lighting assembly adapted for mounting as a single unit on a conical structure such as a Christmas trees or the like.

2. Prior Art

Conventional Christmas tree lighting sets commonly include a plurality of female socket elements, each adapted to receive a screw-in or bayonet-type lamp element, mounted in a spaced relationship along a pair of elongate insulated conductors that terminate at least at one end, and more usually at both ends, in an attachment plug receptacle element for effecting interconnection to a source of electricity and/or to another string of lights. Such sets conventionally have the lamp elements arranged in either a series or parallel connection and the voltage and current ratings of the lamp elements employed are selected in accord therewith.

The mounting of such strings of lights on Christmas trees is generally relatively burdensome in that as they are removed from storage, and after the strings are untangled, commonly with the help of young children and house pets, it normally requires careful positioning thereof to avoid weighing down the branches of the tree, to facilitate interconnection of successive strings and to obtain a relatively uniform distribution of lights for aesthetic purposes. In summary, after the prior art light strings are removed from storage and untangled, they must be deployed on the surface of the tree in such a manner that (a) there is no localized overweighting of branches, (b) successive strings of lights plug into each predecessor and (c) there results a balanced presentation of lights over the surface of the tree.

To facilitate deployment of Christmas tree lights, Ahroni in U.S. Pat. Nos. 4,720,773 and 4,736,282, describes a mounting collar for use with conventional strings of Christmas lights. The mounting collar surrounds the tree trunk near the top of the tree. The collar presents a circumferential row of mounting tabs or posts over which the wires of a light string may be looped or hooked at regular intervals to divide the light string into a series of depending loops. Ahroni's collar, being separate from the light string(s), does not provide a convenient tangle-free unitary assembly useful for facile storing and redeployment of the lighting assembly. Moreover, the light set taught by Ahroni does not provide for an aesthetically pleasing balanced arrangement of lights over the surface of a tree.

Crucefix in U.S. Pat. No. 4,870,547, describes a Christmas tree light assembly which overcomes the problem of positioning successive strings of lights to permit series connection and thereby provides an assembly which reduces set-up time. Crucefix' assembly provides a Christmas tree lighting system whereby a string of lights can be easily arranged on a Christmas tree. Crucefix' invention comprises Christmas tree assembly with a collar around the top of the tree that plugs into a wall receptacle. Depending from the collar are independent strings of lights. The collar is placed on the tree near its apex, preferably with Velcro fasteners, leaving a plurality of strings of lights dangling downward from the collar. The advantage of Crucefix' lighting assembly is that it is easy to put on the tree and the electrical wiring arrangement prevents overheating of electrical connections. His design, however, does not provide for a balanced presentation of lights in their spatial arrangement because the strings are farther apart at the bottom than they are at the top. Moreover, the dangling strings become entangled during storage making untangling and redeployment more difficult.

Forrer, in U.S. Pat. No. 3,096,943 teaches the use of a unitary web-like assembly of lights for covering a Christmas tree. Forrer's assembly which consists of a plurality of interconnected light-bearing risers, may be wrapped around a tree and fastened to assume a substantially frustro-conical form. Forrer's assembly lacks adjustability. For example, the height of the frustro-conical form must be less than the length of two risers. Thus, it is desirable to provide a single unitary assembly that is adaptable to a variety of tree sizes and shapes.

SUMMARY OF THE INVENTION

It is an object of this invention to provide an improved Christmas tree lighting assembly that incorporates a multiplicity of lighting elements in a unitary and lightweight structure that is readily mounted on a more or less conical tree in a simple manner.

Another object of this invention is to provide a Christmas tree light assembly of simple and economical construction whereby the assembly of lights can be arranged on a Christmas tree by simply wrapping the assembly, which is of unitary construction, around the tree, the assembly, thus positioned, providing a balanced presentation of lights over the entire surface of the tree.

Another object of this invention is to provide an assembly that is easy to remove and which reduces entanglement of its lamps and wires during removal and storage.

Yet another object of this invention is to provide a free top-lighting string which is part of the assembly and depends upwardly from the apex of the assembly, such top-lighting string being useful for lighting the portion of the tree above the apex of the assembly.

A further object of this invention is to provide a sturdy Christmas tree lighting assembly which is relatively inexpensive to manufacture, easy to manipulate, attractive in appearance, easy to store and redeploy, and yet practical and efficient to use.

Other objects and advantages of this subject invention will be set forth in the following portion of this specification and will become apparent from the accompanying drawings which illustrate a presently preferred embodiment that incorporates the principles of the invention.

DETAILED DESCRIPTION OF THE DRAWINGS

Figure 1:
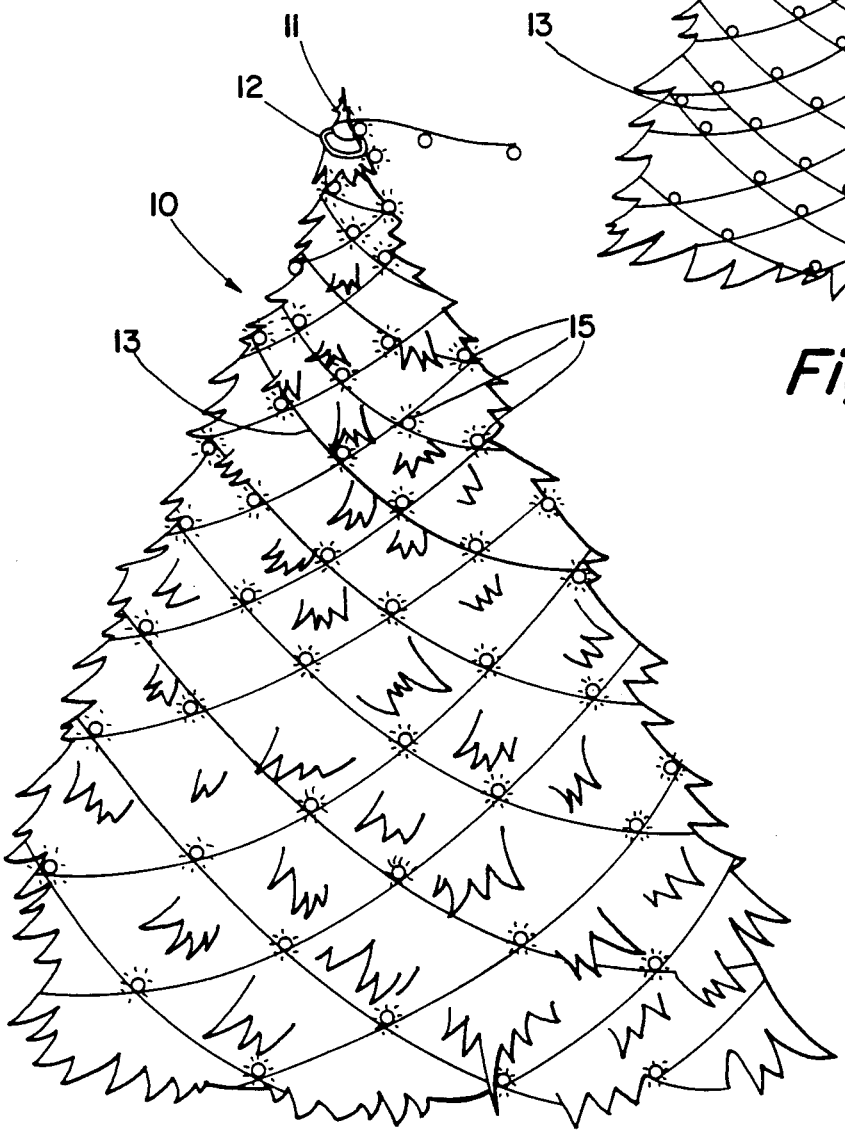
FIG. 1 is a pictorial view showing the position of the apex and dependent strands of lights mounted upon a Christmas tree and including a strand of lights rising above the apex of the assembly.
Figure 2:
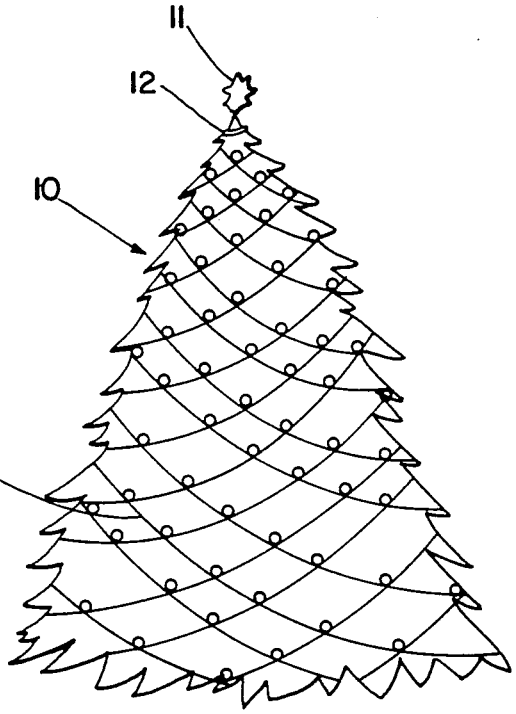
FIG. 2 is a pictorial presentation of the lighting assembly of FIG. 1 deployed over a smaller tree resulting in a closer spacing of lights.
Figure 3:
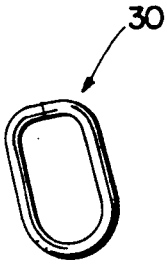
FIG. 3 is a view of a plastic clip used to alternately interconnect adjacent strings of lights.
Figure 5:
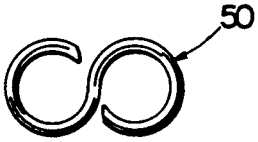
FIG. 5 is a perspective view of a detachable plastic clip useful for fastening the seam of the assembly.

Reference is made first to FIG. 1 which shows a Christmas tree light assembly (10) in accordance with the present invention in place decorating a Christmas tree. The apex (11) of the assembly is reinforced to include a reinforced supporting member (12) which is wrapped around the top of the tree to encircle it and fastened preferably by a releasable fastener such as VELCRO brand of hook and loop fasteners. The remainder of the assembly is supported by the reinforced apical supporting member (12) which is, in turn, supported by the branches radiating from the trunk of the tree at a selected location down from the top of the tree. The secondary light strings (13) are wire conductors with electrical light sockets attached thereto which light strings are interconnected by a first plastic clip (30) (FIG. 3) at interconnecting points (15), alternately drawing adjacent secondary light strings together thereby causing the secondary light strings to zigzag downward from the apex. The expandable web-like nature of the construction provides for an adjustable encirclement as the tree gets wider near the base. As the web near the base is pulled tighter to encircle the increasing radius, vertically adjacent light bulbs are drawn closer to one another, resulting in a more balanced distribution of lights. The seam (41) is then closed with detachable second clips (50) (FIG. 5).

Figure 4:
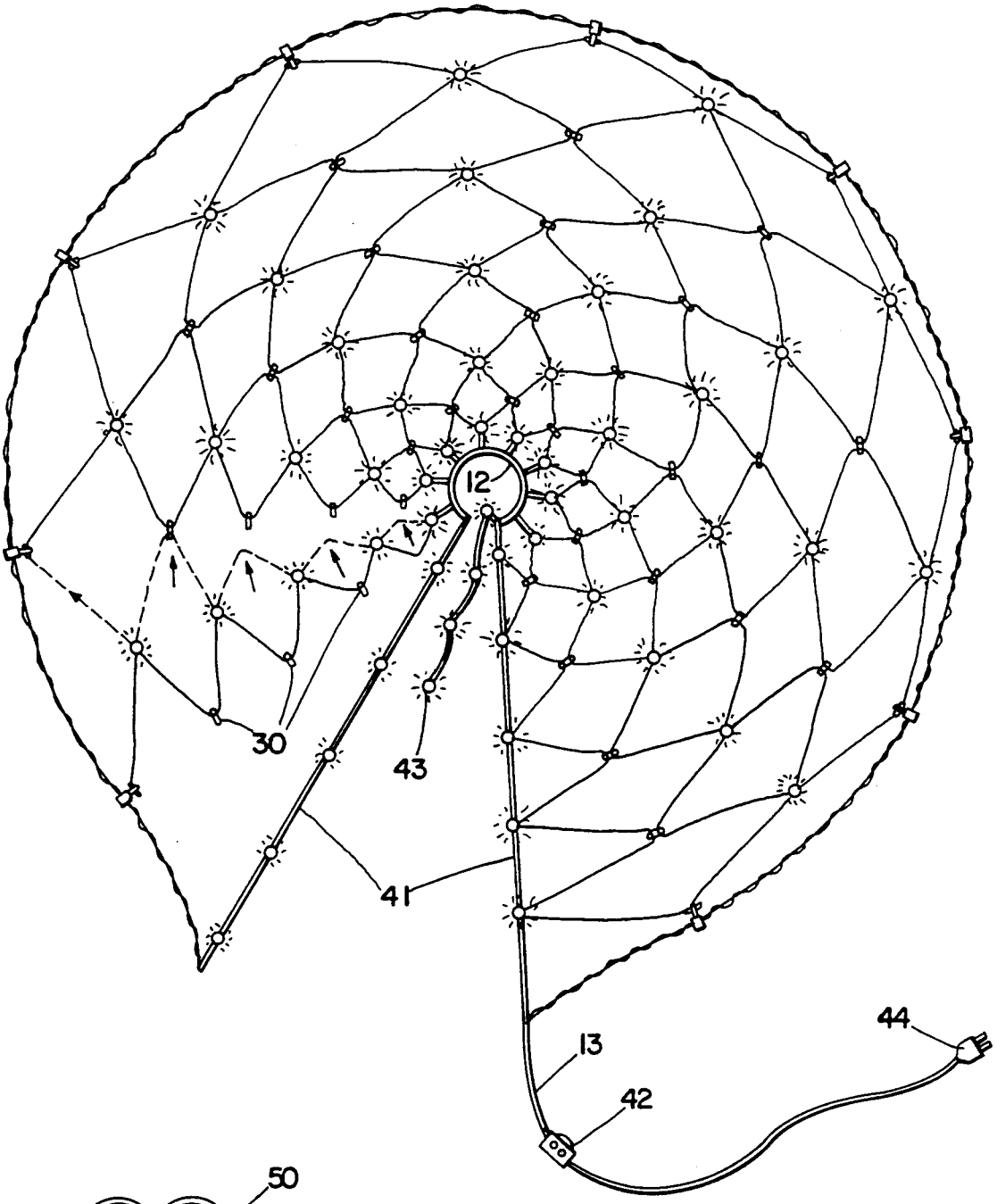
FIG. 4 is a schematic representation of a wiring circuit showing the apex, base, strings and interconnecting elements of the assembly in accordance with this invention.

As will be now apparent, the embodiment of FIG. 4 may suitably be configured by the user to conform to a particular tree to further simplify the mounting thereof. A switch (42) may be wired into one of the primary pair of conductors (13) to simplify electrification of the assembly. The length of the primary pair of conductors (13) leading to the plug (41) is conveniently disposed and said plug and switch are thus rendered readily accessible to provide their respective functions adjacent to the tree base. With the apical support member so disposed, each of the radial extending strings of lamps will be automatically located on the peripheral surface of the tree to readily provide a balanced decorative effect in accord with the desires of the user thereof.

Also shown in FIG. 4 is a schematic view the wiring circuit of the assembly, and also the relative location of different elements comprising the electrical conduction of the assembly as juxtapositioned relative to the apical supporting member with openings in the apical support member effectively shown radiating from the center with a seam (41) and a free strand (43).

When the base of the assembly is stretched laterally to encircle the larger circumference of the base of the tree, the interconnecting of adjacent strings of wires, slidably coupled together by loose plastic clips (30) in the manner shown in FIG. 4, permit the vertically adjacent light bulbs to be pulled together to provide a more balanced distribution of lights encircling the larger base circumference of the tree.

Although the present invention has been described with respect to a preferred embodiment, workers skilled in the art will recognize that changes may be made in the form and detail without departing from the spirit and scope of the invention. For example, the invention may be used to light any conically shaped surface. Its use need not be limited to Christmas trees.

What I claim is:

1. A decorative light assembly of web-like unitary construction for removably and adjustably arranging an array of electrical lights upon the surface of a Christmas tree wherein said array of electrical lights comprises:

(a) a flexible apical support member, said flexible apical support member having fastening means thereon for the removable encircling attachment of said apical support member around the top of a Christmas tree;

(b) a primary electrical conductor, said conductor having one end terminating in a wall plug and the other end terminating in said apical support member;

(c) a plurality of secondary strings of electrical lights radiating outward and depending substantially vertically downward from said apical support member, each of said secondary strings being in electrical communication with said primary electrical conductor and each of said strings having two adjacent secondary strings extending in a direction substantially parallel to each said secondary string, each such secondary string having an apical end and a base end; and (d) interconnecting clips, said interconnecting clips slideably holding together adjacent secondary strings of lights.

* * * * *